United States Patent [19]

Enami

[11] 3,931,997

[45] Jan. 13, 1976

[54] METHOD FOR BREAKING CONCRETE STRUCTURES

[75] Inventor: Akira Enami, Tokyo, Japan

[73] Assignee: Asahi Kasei Kogyo Kabushiki Kaisha, Osaka, Japan

[22] Filed: May 28, 1975

[21] Appl. No.: 581,440

Related U.S. Application Data

[63] Continuation of Ser. No. 395,157, Sept. 7, 1973, abandoned.

[30] Foreign Application Priority Data

Sept. 8, 1972 Japan ..... 47-90154

[52] U.S. Cl. ..... 299/10; 125/23 R; 241/30; 254/93 VA; 299/22

[51] Int. Cl.[2] ..... E21C 37/04

[58] Field of Search ..... 299/10, 15, 22, 23, 33, 299/36, 37; 125/23 R, 236, 23 T; 254/93 VA; 241/30

[56] References Cited

UNITED STATES PATENTS

| | | | |
|---|---|---|---|
| 1,271,940 | 7/1918 | Reilly et al. | 299/22 |
| 2,148,495 | 2/1939 | Osgood | 299/22 |
| 2,346,677 | 4/1944 | Hair et al. | 299/22 |
| 2,878,002 | 3/1959 | Haley | 299/36 |
| 3,727,599 | 4/1973 | Sugiki | 125/23 |

*Primary Examiner*—Ernest R. Purser
*Attorney, Agent, or Firm*—Stevens, Davis, Miller & Mosher

[57] ABSTRACT

Concrete structures including horizontal structures such as slabs, sub-beams and main beams and vertical structures such as internal walls, external walls and columns are broken by a static load applied to the concrete structure by a loading member of a static loading means, which causes bending stress to build up in the concrete structure and finally brings about breakage of the structure. The static load may be applied by hydraulic means, preferably mounted on a movable vehicle.

3 Claims, 18 Drawing Figures

METHOD FOR BREAKING CONCRETE STRUCTURES

Figure 1:
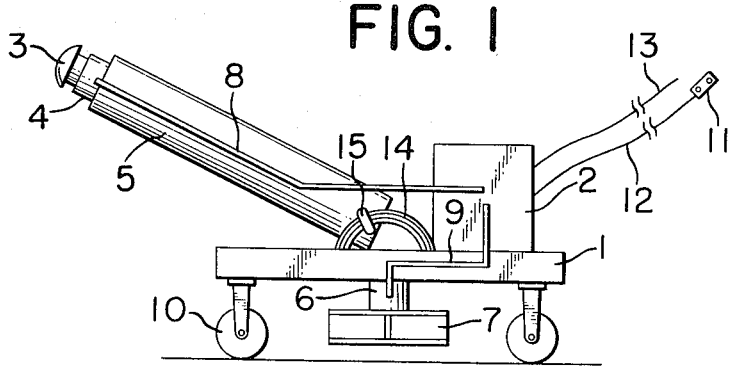

This is a continuation of Ser. No. 395,157 filed Sept. 7, 1973, now abandoned.

BACKGROUND OF THE INVENTION

In recent years, increasingly more reinforced concrete buildings are being demolished to be replaced with new buildings solely by reason of outmoded functionality despite the fact that they are still in perfect condition from the standpoint of durability. In demolishing such buildings, there have heretofore been employed such methods as a steel ball hung from the top of the boom of a crawler crane which is swung against concrete structures, the use of explosives for breaking up concrete structures and the use of a preumatic drill, for example. The method using the steel ball entails a relatively high vibration level in spite of rather low noise level and produces a fairly large amount of dust, and therefore necessitates measures for protecting the neighborhood against possible nuisance. The use of explosives involves high vibration and noise, levels, although momentarily, the use of a pneumatic drill suffers from a fairly high noise level in spite of an extremely low vibration level. Thus, all the conventional methods have their disadvantages.

This invention, therefore, aims to provide a method for breaking existing reinforced concrete structures safely and relatively inexpensively while reducing the generation of noise, vibration and dust as much as possible and also to provide devices for practicing said method.

SUMMARY OF THE INVENTION

The method for breaking concrete structures according to the present invention is characterized by a basic procedure of placing a loading member of a static loading means in contact with a concrete structure, for example horizontal structures such as slabs, sub-beams and main beams and vertical structures such as internal walls, external walls and columns, disposing on the reaction side thereof a reaction force supporting means, generating bending stress in said concrete structure by virtue of the static load exerted by the static loading means via said loading member and breaking the concrete structure near the load point or at the points at which the concrete structure is supported.

The method of this invention can be applied equally effectively to horizontal structures and vertical structures. In breaking horizontal structures, the method can utilize slabs, sub-beams and main beams on the lower floor for securing the reaction force supporting means, making the selection of reaction force relatively simple and easy. Where vertical structures are to be broken, walls and rigid frames erected on the opposite side can be utilized for securing the reaction force supporting means. Where no convenient objects are available for securing said means, the reaction force supporting member can be applied directly against the concrete structures to be broken. In this case, the concrete structures themselves serve as the supports for the reaction force.

In any case, the load point may properly be fixed either near the edge or close to the centre of such peripherally fixed board-like structures as slabs and walls to suit the conditions of the work site. In the case of a load exerted close to the centre of a slab or wall, for example, bending cracks first propagate radially on the side opposite the side of load application from a position corresponding to that of load application and then the wall is broken in a conical shape centering round the point of load application, followed by tensile breakage of the entire wall. The load can be applied to the extent of crack formation in the structure, to a further extent to achieve tensile breakage or to the furthest extent by causing breakage of steel reinforcement, the selection of the extent of breaking being readily accomplished by controlling the degree of load application after due consideration of the site conditions.

Normally, floor slabs and beams are reinforced with steel bars so as to provide high resistance to forces exerted vertically in the downward direction. They are relatively weak against thrusting forces exerted upwardly in the vertical direction. Therefore, floor slabs on the second floor can be broken by applying a load upwardly from the first floor side. In the case of walls, a load is applied on one side alone or on both sides to form breakage at the edge portion or close to the central portion. Thus, a given concrete building can be pulled down without generating noise and vibration.

Depending on the dimensions of a particular concrete structure, the method of the present invention may, of course, require the basic procedure to be repeatedly performed sequentially at a plurality of points, spaced effectively from one another, so as to bring the concrete structure to complete breakage.

The term "static loading means" as used in connection with this invention refers to a means for exerting static load to a given concrete structure via a loading member so as to generate bending stress in said concrete structure. As a specific example it may be a hydraulic jack which is provided at the head portion thereof with a loading member adapted to be placed in contact with the concrete structure so as to exert static load thereon and which is connected through an oil conduit to an oil pressure generating and controlling unit. The term "reaction force supporting means" as used herein refers to a means for holding back the reaction force which is generated when bending stress occurs in the concrete structure in consequence of the application of static load thereto via the loading member of the static loading means. As a specific example it may be a member which is fastened to a suitable concrete structure, if one is available in the neighborhood of the structure being broken, as the structure of the reaction. In the absence of such a convenient neighboring structure, the term refers to a reaction force supporting member which is disposed at points other than the load point on the concrete structure to be broken.

Various embodiments of devices which may be used for the present invention are as follows. Where neighboring concrete structures are available to provide a reaction force, there may be used.

Figure 2:
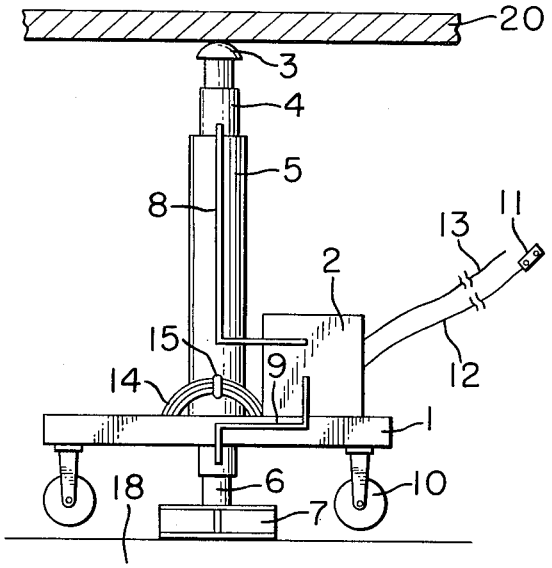
Figure 3:
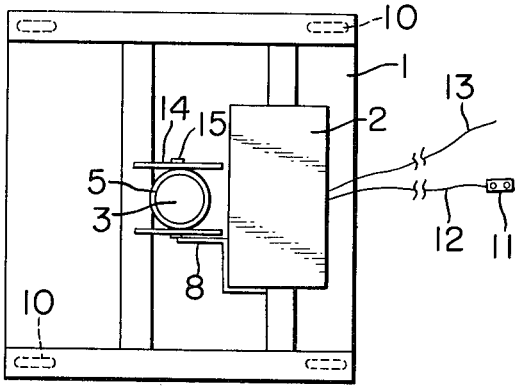
Figure 4:
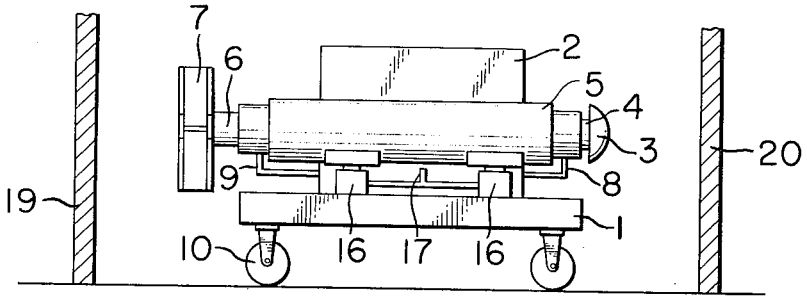
Figure 5:
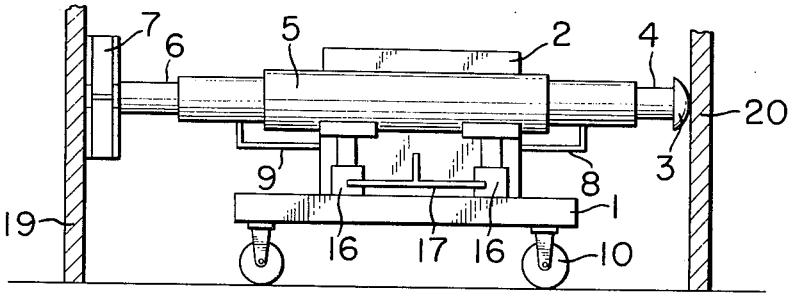
Figure 6:
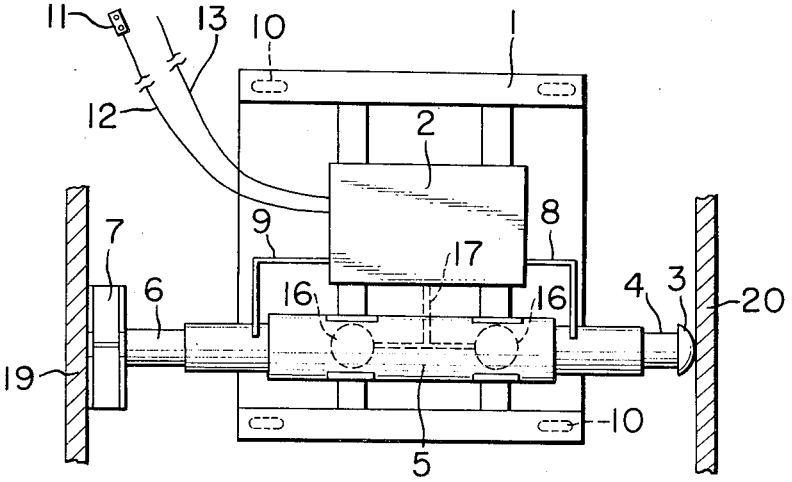

1. a device wherein a hydraulic loading means adapted to be actuated by an oil pressure generating and controlling unit is disposed between a loading member and a reaction force suporting means so as to cause bending stress to be generated in the concrete structure, 2. a device wherein the reaction force supporting means corresponding to that of the device (1) has a greater contact area, 3. a device which is a modification of the device (1) having a loading member and a loading means disposed FIGS. 1 to 3 illustrate a device designed for breaking horizontal structures and FIGS. 4 to 6 a device designed for breaking vertical structures. Referring to FIGS. 1 to 3, a spacer 5 provided at the head portion thereof with a hydraulic jack 4 with a loading head 3 is mounted on a truck 1 freely movable by means of wheels 10, together with an oil pressure generating and controlling unit 2 which is provided with a cap tire cord 12 extended to permit remote control by a hand switch 11 and an electric cable 13 connected to a power source (not illustrated). Under truck 1, a truck lifting jack 6 is disposed vertically to serve the purpose of moving forward and backward a reaction force supporting member 7 having a sufficient contact area. The truck lifting jack 6 adds to convenience of handling. The hydraulic jack 4 and the truck lifting jack 6 are connected via oil conduits 8 and 9 to the oil pressure generating and controlling unit 2. In the present case, the spacer 5 is fixed to the truck in such a way as to be capable of being drawn out to an operating position or retracted to a resting position. To facilitate the handling of the spacer 5, it is attached by a fastener 15 to a supporting rail 14.

In the embodiment shown in FIGS. 4 to 6 wherein like parts are denoted by like numerals as compared to FIGS. 1 to 3, there is a difference in that the truck lifting jack 6 is fastened to the extremity of the spacer 5. There are additionally provided a supporting jack 16 serving to give a vertical motion to the horizontal spacer 5 and an oil conduit 17 connecting the jack 16 to the oil pressure generating and controlling unit 2.

Each of the two devices described above is manoeuvered on a work site by work men pushing manually. Then, the oil pressure generating and controlling unit 2 is actuated and the truck lifting jack 6 is operated to cause the reaction force supporting member 7 to push against the floor surface 18 until the truck 1 is lifted to a suspended position as illustrated in FIG. 2, or to cause said member 7 to be held in contact with a wall 19 as illustrated in FIG. 5. Thereafter, the hydraulic jack 4 pushes the loading head 3 against the wall 20 to be broken until breakage occurs at the point of load application. Thus the device of this invention has mounted on the freely movable truck 1 the means for imparting static load to the concrete structure 20, with the various parts of said means operated by remote control. Therefore, it excels in mobility and safety and permits the work of demolishing buildings to be accomplished without generating noise and vibration. Since the reaction force supporting member 7 has a larger contact area, the force per unit area to be applied by the loading head 3 of the hydraulic jack 4 is without exception greater than that exerted by the reaction force supporting member 7. Even when the concrete structure 20 to be broken and the concrete structure 19 taken as the source of reaction force are of same construction, breakage invariably occurs on the former side. With this device, therefore, it never happens that the floor slab or wall by which the present device is supported will resist against the load. In the devices of FIGS. 1 to 6, the reaction force supporting member 7 may be attached directly to the truck 1 or the spacer 5 without incorporating the hydraulic jack 6.

FIGS. 7 to 11 illustrate another embodiment of the device for breaking concrete structures according to the present invention. A freely extensible boom 22 is attached at one end thereof to a freely movable truck 21 in such a way as to be able to rotate freely in a plane perpendicular to said truck 21. To the other end of the boom 22 is attached a spacer 28 provided with a loading head 26 and a reaction force supporting member 27 so as to impart bending stress to the concrete structure 23 to be broken through a hydraulic jack 25 operated by an oil pressure generating and controlling unit 29. The spacer 28 is attached to the boom 22 via a universal coupling 30 for example an oil motor, in such a way as to be able to rotate freely relative to the boom 22.

Figure 7:
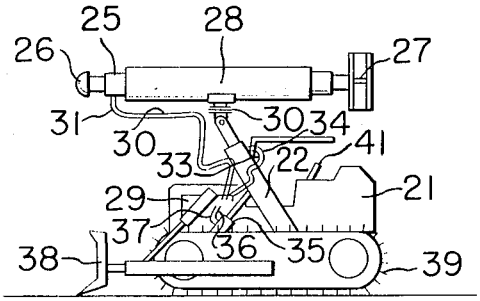
Figure 8:
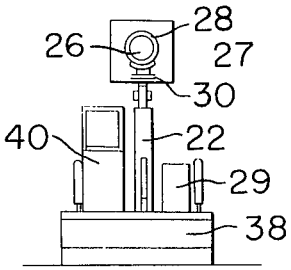

FIGS. 7 and 8 illustrate this embodiment in the state in which it travels to the structure 23 to be broken i.e. in a state in which the device is held at rest. The boom 22 is a hydraulic jack which is connected via oil conduits 33 and 34 to the oil pressure generating and controlling unit 29 and is freely extensible by the operation of the oil pressure generating and controlling unit 29. The boom 22 is attached at the lower end thereof to the truck in such way that it can be freely rotated in a plane perpendicular to the truck 21 by the operation of a hydraulic jack 35 which is connected via oil conduits 37 and 36 to the oil pressure generating and controlling unit 29. The truck 21 in this embodiment is a bulldozer which is provided with a clearing board 38, endless tracks 39, an engine 40 and an operator's seat 41.

Figure 9:
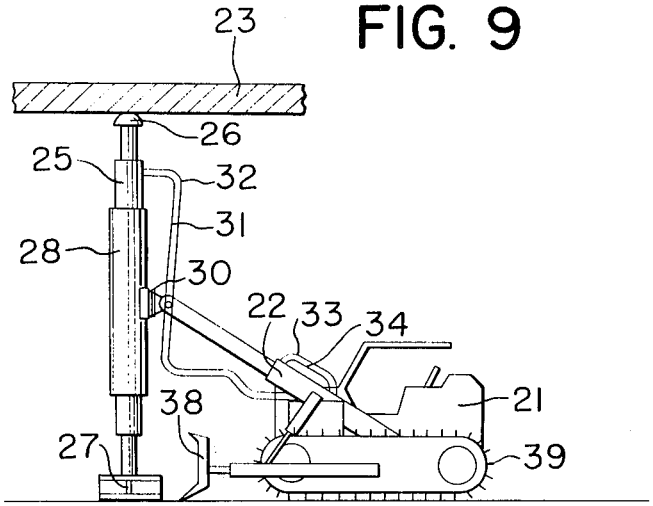

FIG. 9 illustrates this embodiment in a state in which the device is in the process of breaking a concrete structure such as slab or beam. After this device has been transported to the work site in the state illustrated in FIGS. 7 and 8 the oil pressure generating and controlling unit 29 is put in to operation so that the boom 22 and the universal coupling 30 will be moved to a position permitting the loading head 26 at the head of the hydraulic jack 25 to face the concrete structure 23. The reaction force supporting member 27 attached to the spacer 28 is brought into firm contact with the floor. Then, the oil pressure generating and controlling unit 29 is operated so as to bring the loading head 26 into contact with the concrete structure 23. Finally, static load is delivered through the loading head 26 to the concrete structure 23 to generate bending stress therein until the accumulated stress breaks the concrete structure 23.

Figure 10:
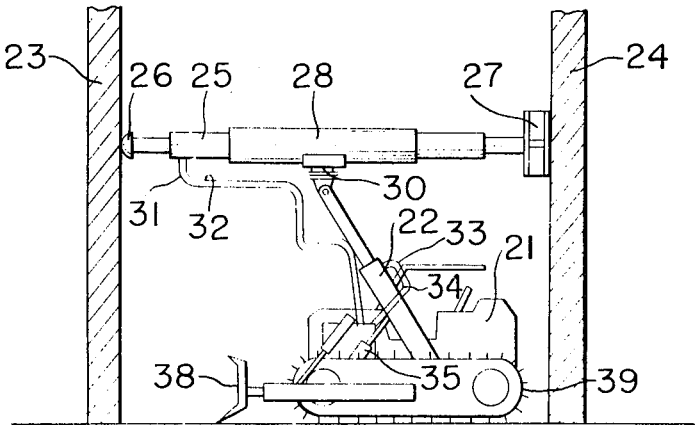

FIG. 10 illustrates this device in a state in which it is in the process of breaking a concrete structure such as wall or column. In this case, desired breakage can be accomplished by repeating the procedure illustrated in FIG. 9 except that the reaction force supporting member 27 is held in contact with an adjacent concrete structure 24 such as wall or column. In this case, since the contact area of the loading head 26 is smaller than that of the reaction force supporting member 27, breakage occurs on the concrete structure 23. It never happens that breakage will occur in the concrete structure 24.

Figure 11:
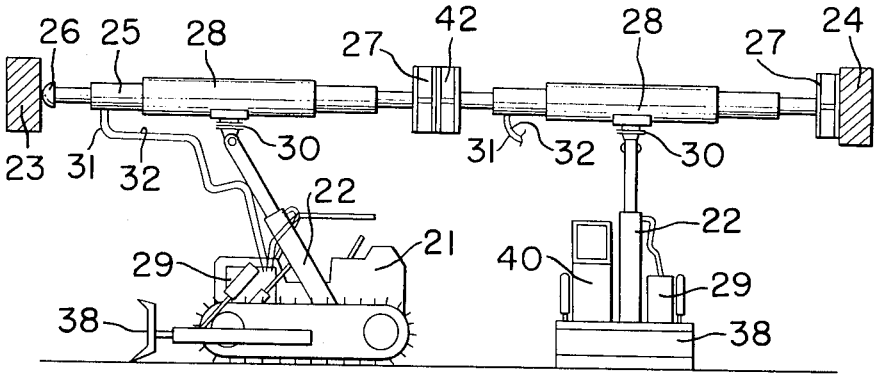

FIG. 11 illustrates a case in which beam separated by a large span from an adjacent beam is being broken by using the device illustrated in FIGS. 7 to 10 in conjunction with another device of the same design, except that the loading head 26 attached to the head of the hydraulic jack 25 is substituted with a reaction force supporting member 42. The reactor force supporting member 27 fastened to the hydraulic jack 25 as illustrated in FIG. 11 may be moved forward and backward by the operation of the hydraulic jack 25.

The embodiment illustrated in FIGS. 7 to 11 operates very efficiently because the powered vehicle can transport the truck 21 to the work site and accurately locate the spacer 28 at a prescribed position in the work site.

The position of the spacer 28 can be finely adjusted by the operation of the truck 21 and further, broken pieces resulting from the breakage of the concrete structure 23 can be cleared by the clearing board 38.

Figure 12:
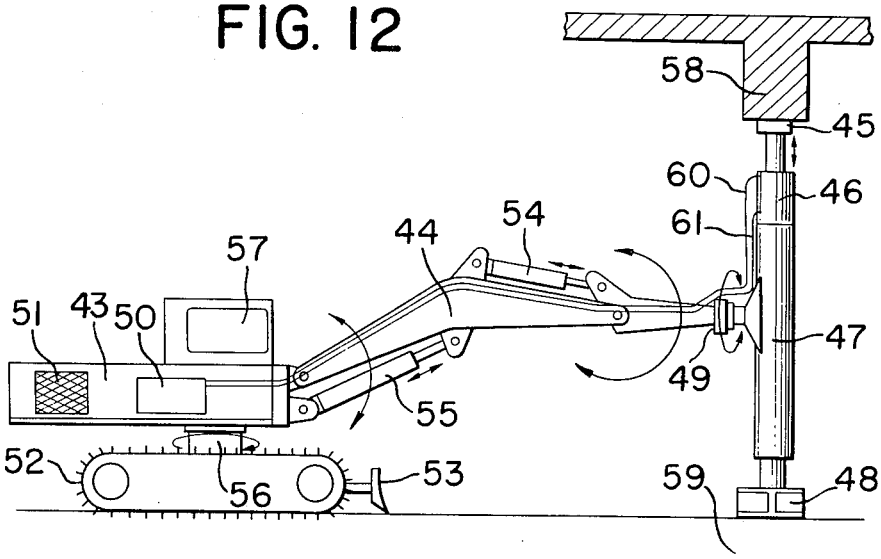

FIG. 12 illustrates another embodiment of the device for breaking concrete structures according to the present invention. In this embodiment, a freely extensible arm 44 is attached at one end thereof to a freely movable truck 43 in such way as to be able to rotate freely in all directions in planes horizontal and perpendicular to the truck 43. A spacer 47 provided with a loading head 45 and a reaction force supporting member 48 and also provided with a hydraulic jack 46 operated through the oil conduits 60 and 61 by an oil pressure generating and controlling unit 50 is attached via a universal coupling 49 to the other end of the arm 44 in such way as to be able to rotate freely relative to the arm 44.

The arm 44 can freely be pulled upward and downward by the operation of hydraulic jacks 54 and 55 which are actuated by the oil pressure generating and controlling unit 50. By the operation of a rotation member 56 mounted on the truck 43, the arm 44 can be rotated to all directions in a plane horizontal to the truck 43. The arm 44 is attached at one end thereof to the truck 43 and at the other end to the spacer 47 via a universal coupling 49 such as oil motor. This spacer 47 may be identical with the spacer 28 illustrated in FIG. 7.

In this device, an operator in the operator's seat 57 operates an engine 51 to actuate the oil pressure generating and controlling unit 50 so as to fold the arm 44 by means of hydraulic jacks 54 and 55 and hold the spacer 47 in an stowed position under the arm 44. The truck is driven to the work site, with the arm 44 and the spacer 47 dept in the stowed position. After the truck has arrived at a prescribed position in the work site, the arm 44 is stretched so that the loading head 45 fixed to the spacer 47 faces the concrete structure 58 to be broken and the reaction force supporting member 48 is brought into contact with the floor 59. Thereafter, the oil pressure generating and controlling unit 50 is operated so as to bring the loading head 45 into contact with the concrete structure 58 and apply bending stress on the concrete structure 58 until breakage occurs.

In this device, the spacer 47 can freely be rotated to all directions around a universal coupling 49 attached to the spacer 47. Further, the arm 44 to which the universal coupling 49 is attached can freely be extended or contracted and turned right or left and up or down by means of the hydraulic jacks 54 and 55 disposed on the arm 44. Therefore, the spacer 47 can freely be rotated in all directions in planes horizontal and perpendicular to the truck 43. As a consequence, the spacer 47 can be placed at the work site and operated to break the concrete structure without reference to the arrangement in which the concrete structure is positioned.

The truck 43 can travel on endless tracks 52 and the clearing board 53 can clear broken pieces resulting from the breakage of concrete structure by the loading head 45. The operator who drives the truck 43 can set the spacer 47 at any prescribed position on the work site. The position of the spacer 47 can then be adjusted finely by the operation of the truck 43. Thus, this device performs with high efficiency.

The reaction force supporting member 48 fastened to the oil jack 46 as illustrated in FIGS. 7 to 11 may be adapted so as to freely be moved forward and backward by the operation of the hydraulic jack 46.

Figure 13:
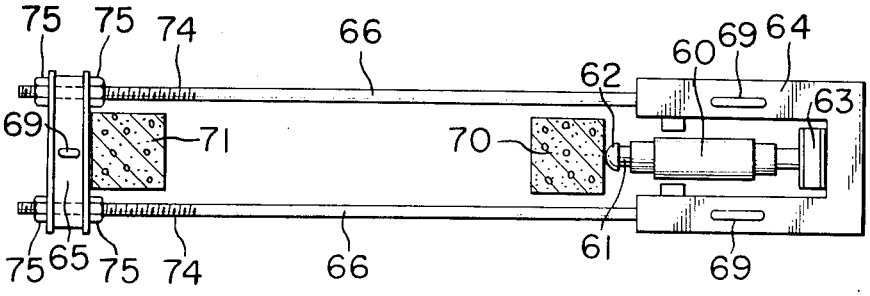
Figure 14:
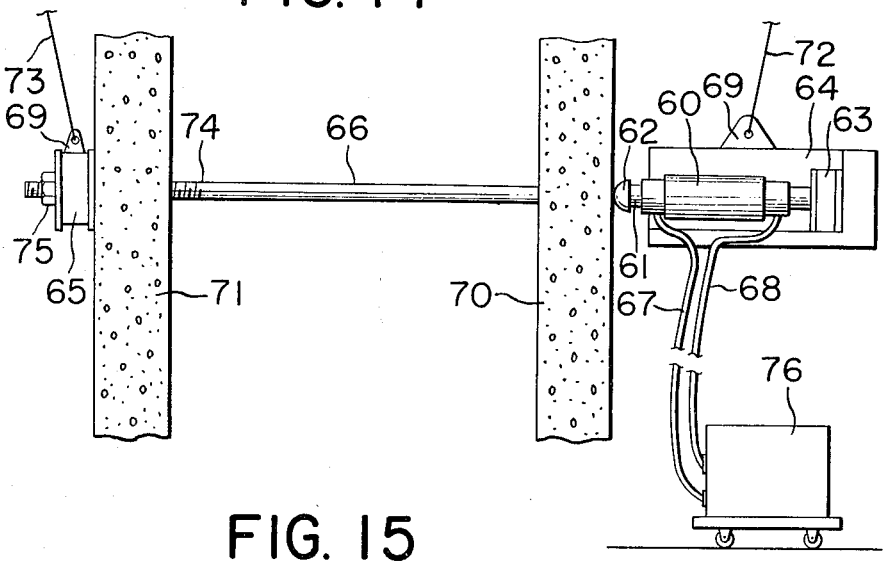

FIGS. 13 and 14 illustrate yet another embodiment of the device for breaking concrete structures according to the present invention. In this embodiment a hydraulic jack supporting frame 64 freely and liftably suspended by a suspending wire 72 along a beam or column 70 of a concrete structure and a connecting frame 65 freely and liftably suspended by a suspending wire 73 along another beam or column 71 are connected by connecting rods 66 positioned at opposite sides of the two beams or columns 70, 71. A loading head 62 adapted to apply concentrated load upon the opposite face of the beam or column 70 is fastened to the end of a freely retractable piston rod 61 of a hydraulic jack 60 connected via oil conduits 67 and 68 to an oil pressure generating and controlling unit 76. The rear end of the hydraulic jack 60 is interlocked with the connecting frame 65 through the supporting member 63 having a greter load receiving area.

In the diagrams, 69 is a metal piece for fastening the suspending wires 72 and 73, and 74 and 75 respectively a thread formed on the connecting rod 66 and a nut screwed on the thread.

Once the supporting frame 64, the connecting frame 65 and the two connecting rods 66 are set around the two columns 70 and 71 spaced by a certain distance from each other as shown in the diagrams, this device can quite easily be set to any desired height of the columns 70 and 71, by simply adjusting the suspending wires 72 and 73. When the device is set at a suitable position, the loading head 62 is pushed out by operating the piston rod 61 of the hydraulic jack 60 by the oil pressure from the oil pressure generating and controlling unit 76. Since the supporting frame 64 of the oil jack 60 is fastened with the two connecting rods 66 and the connecting frame 65 on to the other column 71, and further since the load receiving area of the loading head 62 is far smaller than that of the connecting frame 65, the static load exerted by the loading head 62 to the surface of the column 70 eventually breaks that portion of the column. By sequentially shifting the device to other positions selected for breakage on the same column and repeating the procedure, the entire column 70, however long it may be, can be broken with extreme simplicity.

The supporting member 63 fixed to the rear of the hydraulic jack 60 as illustrated in FIGS. 13 and 14 may be adapted so as to be moved forward and backward by means of the hydraulic jack 60.

FIGS. 15 to 18 illustrate another embodiment of the device for breaking concrete structures according to the present invention. In this embodiment, a hydraulic jack 81 connected via oil conduits 79 and 80 to an oil pressure generating and controlling unit 78 is fixed on the axis of symmetry of a reaction force supporting frame 77 having the shape of an arch. A loading head 83 adapted to confer concentrated load upon the face 91 of the concrete structure to be broken is attached to the end of the piston rod 82 of the hydraulic jack 81. Reaction force supporting members 84 adapted to be held in contact with the plane 92 opposite the plane 91 of the concrete structure 90 are formed at the ends of the arched reaction force supporting frame 77.

Figure 15:
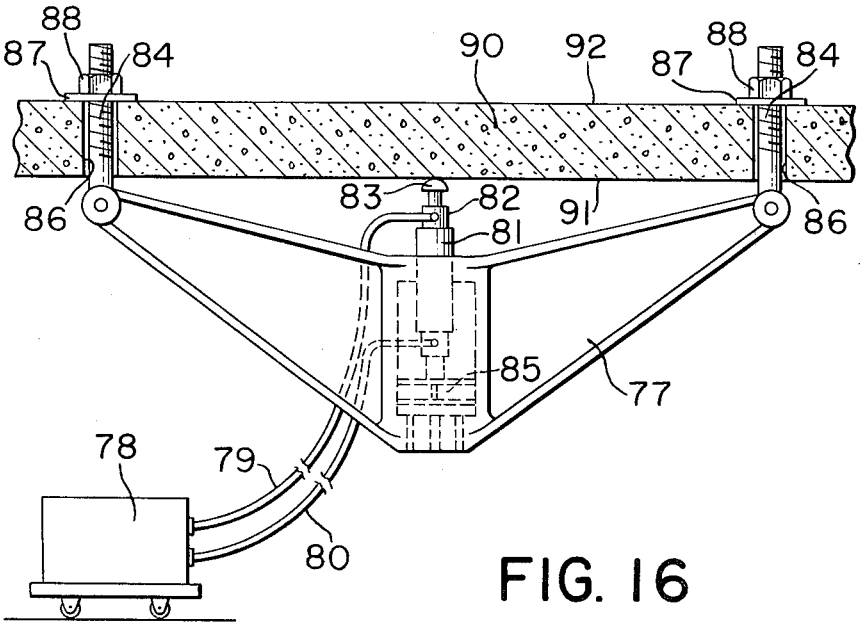
Figure 16:
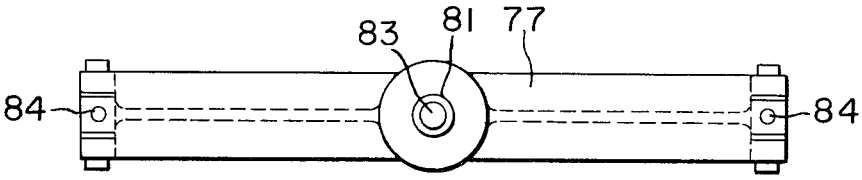
Figure 17:
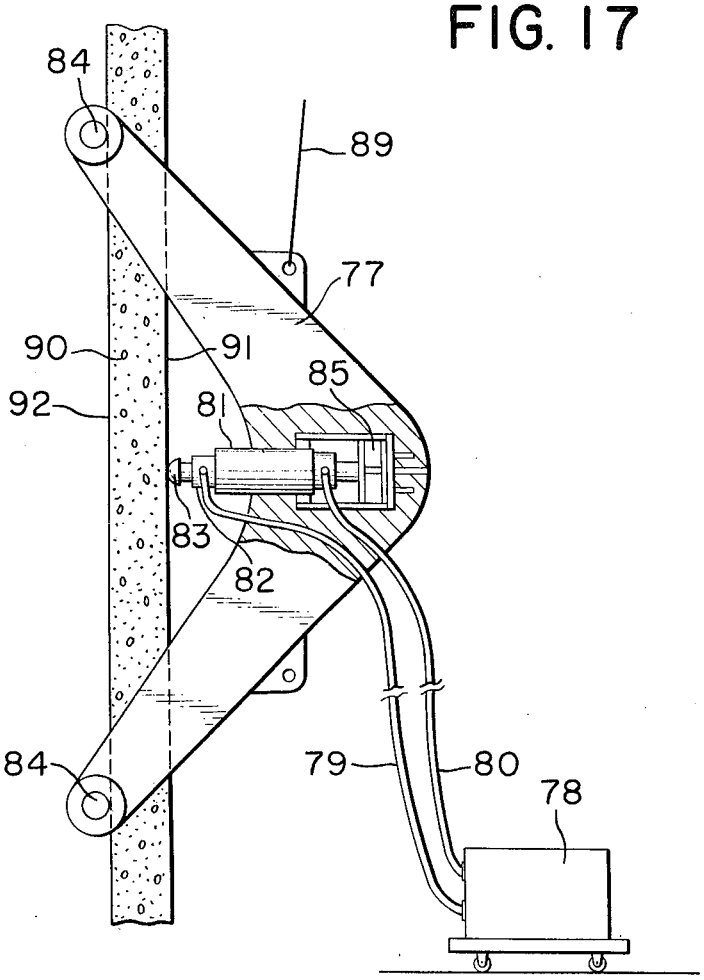
Figure 18:
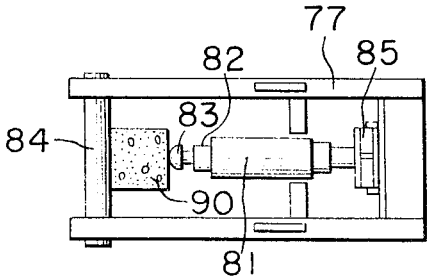

FIGS. 15 and 16 illustrate a case in which this device is used for breaking concreat structures such as walls and floors. FIGS. 17 and 18 illustrate another case in which breakage of concrete structures such as columns and beams is effected by a modification of the present device.

In either case, a loading head 83 adapted to confer concentrated load upon one face 91 of the concrete structure 90 to be broken is attached to the end of the load applying piston rod 82 of the hydraulic jack 81 on the axis of symmetry of the arched reaction force supporting frame 77 and reaction force supporting members 84 adapted to be held in contact with the face opposite the face 91 are formed at ends of the reaction force supporting frame 77. A supporting member 85 having a large contact area is fastened to the rear portion of the hydraulic jack 81 and this supporting member is so disposed as to be brought into contact with the reaction force supporting frame 77. In the case of FIGS. 15 and 16, anchor bolts are used as the reaction force supporting members 84. These anchor bolts are passed through holes 86 bored in advance through the concrete structure 90 to be broken and fixed in position by means of washers 87 and nuts 88 to suspend the device.

In the case of FIGS. 17 and 18, pin joints are used as the reaction force supporting members and they are suspended by means of suspending wires 89, for example. The oil pressure generating and controlling unit 78 and the hydraulic jack 81 are co-nected with oil conduits 79, 80 to each other to permit free forward and backward motion of the loading head 83. This connection by means of oil conduits is common to both the cases under discussion.

The reaction force generated against the concentrated static load exerted by the loading head 83 can be equally supported by the reaction force supporting members 84 which are separated by substantially equal distances from the point of load application. Further, since the reaction force supporting members 84 are held in contact with the face 92 opposite the surface 91 of the concrete structure 90 on which the static load is applied by said loading head 83. The concrete structure itself can serve as the source of reaction force in the case of a horizontal concrete structure 90 as illustrated in FIG. 15 and in the case of a vertical concrete structure 90 as shown in FIG. 17 as well. Moreover the reaction force supporting members 84 which are formed at free ends of the arched reaction force supporting frame 77 can easily be located outside the range within which the breakage caused by the load of the loading head 83 has its effect. The object of the present invention, therefore, can be accomplished by accurately applying concentrated load for the breakage and performing the work of breaking safely and efficiently.

The supporting member 85 fixed to the rear portion of the hydraulic jack 81 as illustrated in FIGS. 15 to 18 may be adapted so as to be moved forward and backward by the operation of the hydraulic jack 81.

Working examples which specifically illustrate the method of this invention will be described below with reference to the devices illustrated in the attached drawings.

EXAMPLE 1

The device illustrated in FIG. 1 was used to apply static load to the centre of a floor slab on a second floor (slab area 3.6 m × 4.8 m. slab thickness 105 mm, reinforcement with main steel bars 13 mm and sub-steel bars 9 mm in diameter) upwardly from the first floor. First cracks occurred when the load rose to 5 tons and breakage accompanied by a booming sound occurred when the load reached 8 tons.

A hole similar in shape to the hemispherical loading head occurred on the side of load application (ceiling side) and an opening of a square of about 70 cm was formed on the opposite side (floor side). Then, the device was moved to the four corners of the floor slab one after another operated to apply the same static load. Substantially the same effects of breakage were obtained. Finally, the steel exposed through the broken holes were cut off by a gas burner.

EXAMPLE 2

The device illustrated in FIG. 4 was used to break a wall on the first floor (wall area 4.8 m (width) × 4.98 m (height), reinforcement with horizontal and vertical steel bars invariably 9 mm in diameter, wall concrete thickness 140 mm and mortar coat thickness 25 mm), with an iron plate 180 mm square used as the loading head. The static load was applied at a point 1 m above the floor surface and 1.4 m from the side wall. Initial cracks occurred when the load rose to 4 tons, the cracks increased in size accompanied by a small sound when the load rose to 12 tons, and breakage with a booming sound occurred when the load reached 14 tons.

A hole similar in shape to the loading head was formed on the side of load application (inside the room) and a cracked portion of an area of about 90 cm × 70 cm was formed on the opposite side (outside the room), with the cracked portion protruding by about 4 cm. After the breakage, the loading head was pushed ahead to the full stroke of the jack 4 without increasing the magnitude of the static load. As a consequence, a concrete portion similar in area to the loading head was pushed put of the wall surface and the cracked portion fell out of position.

Thereafter, the loading head was shifted to varying heights of the wall by operating the jack 16 and operated to repeat the procedure. Substantially the same effects of breakage were obtained. Finally, the steel bars exposed through the broken holes were cut off by a gas burner.

EXAMPLE 3

To one of the square columns (500 mm × 500 mm square, reinforcement with 10 steel bars of 22 mm in diameter) facing to each other at a space interval of 6 m, static load was applied at a point of 2 m height above the floor in such a manner as shown in FIGS. 13 and 14. The main beams were kept attached between the columns.

Initial cracks occured and ran obliquely towards the loading head from the inside surface of the column when the load reached 120 tons. Then another cracks appeared at the outside surface arround the connecting parts of the columns with the main beams. When the load got to 170 tons, the cracks around the loading head got larger with a booming sound. Successively, the load was applied to the column. Though the load lowered down gradually, the cracks around the loading head and the connection parts were increased and finally the steel bars were exposed.

On the other hand, cracks also occurred around the connecting parts of the column with main beams on the reaction side and they were increased. Initial cracks were also found around the place where connection frame was locked.

EXAMPLE 4

The device as shown in FIGS. 17 and 18 having an arch-shaped reaction force supporting frame each end of which was provided with a reaction force supporting member at 4 m interval, was used to break 7 m span main beam (700 mm by 350 mm, reinforcement with two steel bars of 22 mm diameter at the upper section and three steel bars of the same diameter at the lower section). The device was powered with oil jack and when the load reached 40 tons, initial cracks ran obliquely towards the loading head from the surface opposite the loading side.

When the load reached 60 tons, the cracks were enlarged much with a booming sound and, at the same time, the connecting parts of the main beam with the columns and other parts of the main beam cracked. The jack was successively loaded. Though the load lowered down gradually, the cracks around the loading head and the connecting parts were developed, so that the steel bars were exposed at last.

I claim:

1. A method of breaking a two sided concrete structure having reinforcing members designed to withstand stress from a first side and characterized by having adjacent to the second side of said two sided structure an independent concrete structure comprising placing a hydraulic jack between said two adjacent concrete structures with one end of said jack having a loading member placed in contact with said second side of said two sided concrete structure and placing the other end of said jack having a reaction force supporting means in engagement with said independent concrete structure, and applying hydraulic pressure to said hydraulic jack to apply a bending stress to said two sided concrete structure whereby said two sided concrete structure is broken.

2. A method of breaking a reinforced concrete building having concrete structures selected from the group consisting of horizontal slabs, sub-beams and main beams comprising standing on a floor a hydraulic pressure loading means having a loading member at its upper end, and a reaction force supporting member with a larger contact area than said loading member at its lower end, contacting said loading member to said concrete structure from the bottom for applying a static load by means of said hydraulic pressure loading means, and thereby breaking said concrete structure by generating the bending stress therein for minimizing the ultimate strength of said concrete structure to which said loading member is contacted.

3. A method according to claim 2 wherein said hydraulic pressure loading means is mounted on a freely movable vehicle.

* * * * *